US006137097A

United States Patent [19]

Smith et al.

[11] Patent Number: 6,137,097

[45] Date of Patent: Oct. 24, 2000

[54] RESIZABLE MICROWAVE OVEN LINER APPARATUS AND METHOD

[76] Inventors: Rose Mary Smith, 39 N. Grand St.; Elizabeth Hogan; David Hogan, both of 87 N. Grand St., all of Cobleskill, N.Y. 12043

[21] Appl. No.: 09/374,358

[22] Filed: Aug. 13, 1999

[51] Int. Cl.[7] ..... H05B 6/80

[52] U.S. Cl. ..... 219/725; 219/756; 219/392; 99/DIG. 14; 126/39 M

[58] Field of Search ..... 219/756, 725, 219/391, 392, 395; 126/39 M; 99/DIG. 14, 451

[56] References Cited

U.S. PATENT DOCUMENTS

| | | | |
|---|---|---|---|
| Re. 34,829 | 1/1995 | Stone . | |
| 4,190,757 | 2/1980 | Turpin et al. . | |
| 4,563,559 | 1/1986 | Enami . | |
| 4,633,052 | 12/1986 | Beavers et al. | 219/756 |
| 4,714,013 | 12/1987 | Telfer | 99/449 |
| 4,721,140 | 1/1988 | Coker . | |
| 4,778,968 | 10/1988 | Torres | 219/756 |
| 4,785,160 | 11/1988 | Hart . | |
| 4,797,523 | 1/1989 | Kohnen . | |
| 4,801,773 | 1/1989 | Hanlon . | |
| 4,937,410 | 6/1990 | Anderson . | |
| 4,950,859 | 8/1990 | Anderson . | |
| 4,965,424 | 10/1990 | Bagley . | |
| 5,026,957 | 6/1991 | Pralus | 219/756 |
| 5,026,958 | 6/1991 | Palacios . | |
| 5,235,149 | 8/1993 | Boehrer . | |
| 5,290,985 | 3/1994 | Jancic et al. | 219/756 |
| 5,436,434 | 7/1995 | Baird . | |
| 5,770,840 | 6/1998 | Lorence . | |
| 5,814,382 | 9/1998 | Yannuzzi, Jr. . | |
| 5,834,046 | 11/1998 | Turpin et al. . | |
| 5,927,266 | 7/1999 | Maugard | 126/39 M |

*Primary Examiner*—Philip H. Leung
*Attorney, Agent, or Firm*—Jay R. Yablon

[57] ABSTRACT

A pleated microwave liner bag comprising a plurality of liner pleats, is expandable in the preferred embodiment from initial dimensions of approximately 6 inches in height by 11 inches in width, to final dimensions as large as approximately 15 inches in height by 21 inches in width, by ⅛ inch increments. This liner bag, by virtue of its resizability (scalability), can be used to protect a wide range of sizes of microwave oven from spills and spatters associated with the microwave cooking and heating process.

34 Claims, 4 Drawing Sheets

RESIZABLE MICROWAVE OVEN LINER APPARATUS AND METHOD

FIELD OF THE INVENTION

This invention relates generally to the fields of protective coverings, and specifically, to protecting a microwave oven from food spills and spatter.

BACKGROUND OF THE INVENTION

Microwave ovens are widely used all over the world to heat and cook food items much more rapidly than conventional heating ovens. But the nature of microwave technology is such that in the process of heating food items, the microwaves will often cause the food items to overflow, or to "pop," which of course, produces a mess along the sides, back and front (interior surface) of the microwave oven that needs to be cleaned with a sponge or similar cleaning apparatus. This entails reaching into the oven and applying "elbow grease" at various awkward angles, and as anyone who uses and has ever had to clean a microwave oven is aware, is tiresome and difficult.

The U.S. Patent literature does disclose some efforts to solve this problem. U.S. Pat. Nos. 4,721,140; 4,785,160; 4,797,523; 4,801,773; and 4,950,859, for example, all disclose various containers, covers, shields, etc., that are placed over or around a particular food item being cooked, in order to block and prevent spills and spatters from that food item from reaching the inner surface of the microwave oven. But these are associated in their use with each individual food item being cooked, rather than with the microwave oven itself. As such, these devices are removed along with the associated food item each time a food item is heated or cooked, and reintroduced into the microwave oven each time a new food is to be cooked.

U.S. Pat. Nos. 4,663,052; 4,778,968; and 5,290,985 improve this situation, since these protective devices are each used in connection with the microwave oven itself, and remain in place to guard against spills and spatter from the cooking of one food item to the cooking of subsequent foods items. After a time, once the protective device has become soiled beyond a certain point, the device is removed and disposed of, and is replaced with a new, similar device.

But microwave ovens are manufactured and sold in many varied sizes, and all of U.S. Pat. Nos. 4,663,052; 4,778,968; and 5,290,985 suffer the common deficiency that they cannot easily be used in connection with varying sizes of microwave oven. Indeed, a survey taken by applicants of over 100 microwave oven models reveals that microwave ovens typically vary in volume from about 0.5 to 1.8 cubic feet, and in linear dimension from a minimum height of about 6 inches to a maximum height of about 15 inches, from a minimum width of about 11 inches to a maximum width of about 21 inches, and from a minimum depth of about 10 inches to a maximum depth of about 18 inches. This survey also reveals that these linear dimensions typically vary by ¼ inch, ⅛ inch, ⅙ inch, or 1/16 inch increments. Given this wide size variability from one microwave oven to the next, it would be difficult or impossible to use the protective devices of U.S. Pat. Nos. 4,663,052; 4,778,968; and 5,290,985 for more than a single size of microwave oven, give or take perhaps a fraction of an inch along any one linear dimension. As such, if these protective devices were to be used for all commonly-manufactured oven sizes, it would be necessary to manufacture dozens of different sizes of these protective devices.

In addition, all of these liners are difficult to set up and attach for use inside the microwave oven, and (e.g., U.S. Pat. No. 4,778,968, column 2, lines 58–61) even need an independent support structure.

These liners also do not appear to provide suitable protection for the front door of a microwave oven.

Additionally, the choice of materials used to construct a microwave liner is very important. Saran-type polymeric materials do not hold up well over time and are meant for one use and then disposed of. They do not have a heat history at all, melting in the presence of steam resulting from cooking food. Cardboard-type material and papers commonly used in paper bag construction are not appropriate either. These materials absorb moisture and spilled foods. This causes them to stick to the microwave interior, defeating their purpose and usefulness.

OBJECTS OF THE INVENTION

It would be desirable therefor, to provide a microwave oven liner which can be configured (resized or scaled) to protect a wide range of microwave oven sizes, encompassing at least the size ranges noted in the background of the invention.

It would further be desirable if this resizing could be achieved at various small increments, permitting the microwave oven liner to be resized to any height from about 6 inches to 15 inches, and to any width from about 11 inches to about 21 inches, and to any depth from about 10 inches to about 18 inches by, for example, not limitation, ⅛ inch increments.

It would further be desirable to provide a simple means to attach the microwave oven liner to the microwave oven, once it has been resized to the dimensions appropriate to the given microwave oven for which it is to be used.

It would further be desirable to provide a means for protecting the front door of a microwave oven, in addition to protecting the sides, top, bottom, and back of the microwave oven.

It would further be desirable to provide a microwave oven liner which is fabricated from a material which has structural integrity and is able to free-stand in the microwave device on its own, requiring minimal or no supports, and without imposing undue setup requirements upon the liner user.

It would further be desirable for the liner to be durable under repeated microwave bombardment and heating, so that the liner remains free-standing after many microwave uses, and needs to be disposed of because of the spilled food that it has prevented from being caked on the microwave surface—not due to the liner becoming deformed from heat.

It would further be desirable for the liner bag not to allow food to be absorbed or soaked into its surface, as this would cause the liner to stick to the microwave surface, defeating its purpose.

SUMMARY OF THE INVENTION

The preferred embodiment of the invention disclosed herein is a pleated microwave liner bag comprising a plurality of semi-rigid liner pleats that enable the liner bag to be expanded from initial dimensions of approximately 6 inches in height by 11 inches in width, to final dimensions as large as approximately 15 inches in height by 21 inches in width, for example, not limitation, by ⅛ inch increments. As such, a single liner bag can be produced which is suitable for use in microwave ovens over a wide range of varying sizes. The depth is varied from approximately 10 inches to 18 inches either by folding over the front of the bag on itself, or by removing part of the front of the bag, e.g. by cutting the bag, or by tearing the bag along perforated tear lines.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE INVENTION

Figure 1:
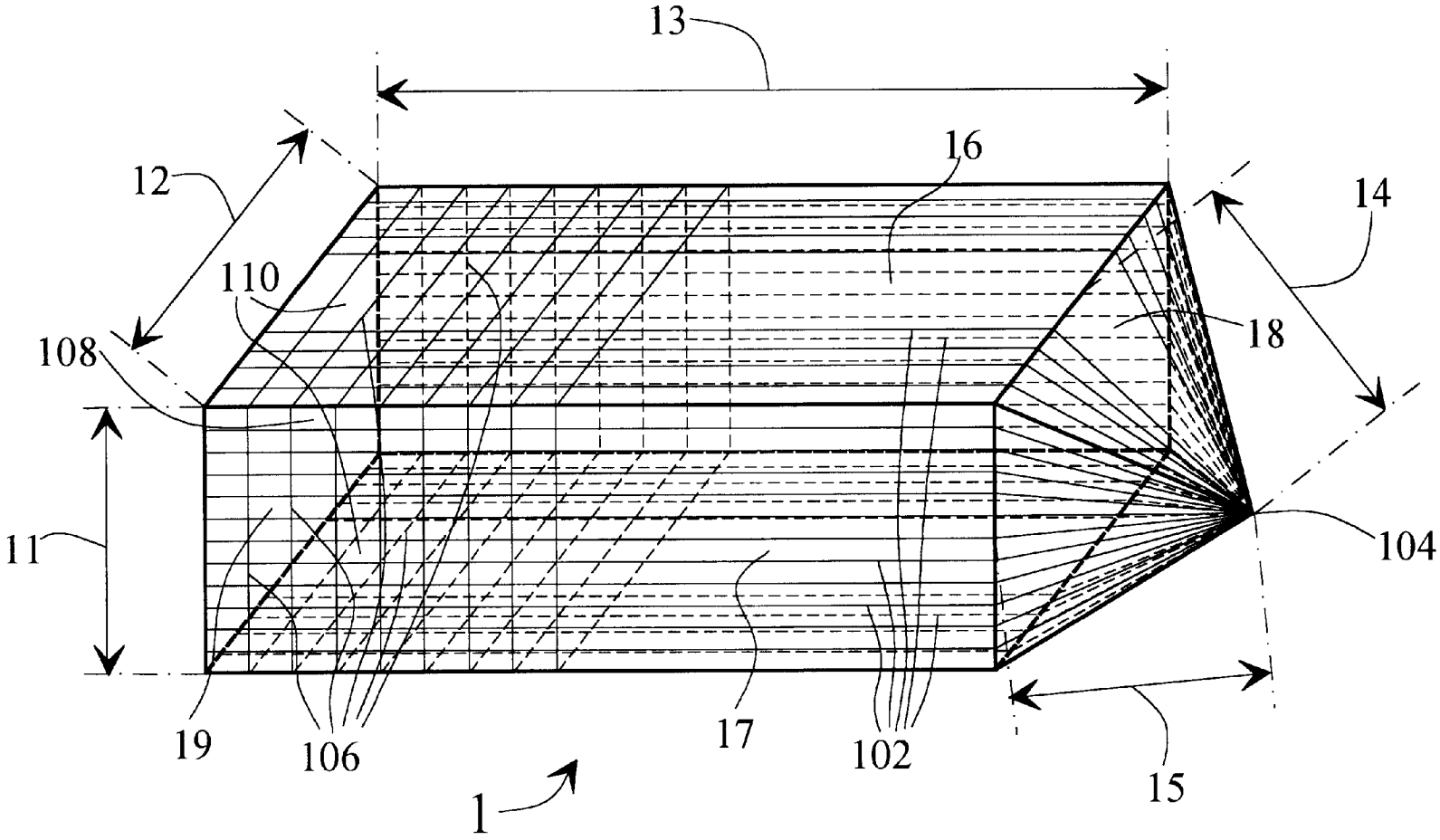
FIG. 1 is a top-rear-right side perspective view illustrating a resizable microwave liner bag in a preferred embodiment of the invention, in a fully collapsed state with all of its pleats closed.

FIG. 1 illustrates a top-rear-right side perspective view microwave liner bag 1 in a fully collapsed (unexpanded) state according to a preferred embodiment of the invention. In this fully collapsed state, microwave liner bag 1 has a height 11 of approximately 6 inches, a width 12 of approximately 11 inches, and a depth 13 of approximately 18 inches. The height and width are chosen to correspond with the smallest sizes of commonly-available microwaves as outlined above; the depth corresponds with the largest of such sizes. Toward its rear region (shown toward the right side of FIG. 1), microwave liner bag 1 comprises a rear surface comprising a "pyramid" surface with a linear dimension of approximately 7.5 inches along height expansion region 14 (a similar region, not marked with a reference numeral, exists on the opposite, lower face of the pyramid), and a linear dimension of approximately 10.5 inches along width expansion region 15 (as similar region, also not marked, exists on the opposite face of the pyramid).

Microwave liner bag 1 comprises a plurality of pleats 102 running horizontally along its top surface 16, its bottom surface 17, its left surface 18, and its right surface 19, substantially in the direction illustrated, as well as a front opening 108 which is fully open. Each pleat continues on through the pyramid surface to a pleat gathering point 104 comprising the tip (apex) of the aforementioned pyramid (at the rear of microwave liner bag 1, which again, is shown toward the right side of FIG. 1).

Microwave liner bag 1 also comprises a plurality of optional depth adjustment lines 106, such as but not limited to pre-cut perforations, which are used to adjust depth 13 of microwave liner bag 1. As illustrated, depth adjustment lines 106 run from left sides of top 16 and bottom 17 surfaces to right sides of top 16 and bottom 17 surfaces, and from tops of left 18 and right 19 side surfaces to bottoms of left 18 and right 19 side surfaces. The function of depth adjustment lines 106 will be further described in detail below, but it is to be observed at this point, if microwave liner bag 1 were to be cut along the rightmost depth adjustment line 106, that its depth would be reduced from approximately 18 inches to approximately 10 inches, which is the smallest depth of commonly-available microwaves.

Finally, microwave liner bag 1 comprises unpleated regions 110 along a central region of top surface 16 and a central region of bottom surface 17. It is to be noted that the lines 102 as illustrated in FIG. 1 representing the pleats do not illustrate the actual pleats themselves (which will be illustrated and discussed in further detail in connection with FIG. 3), but rather, the regions of microwave liner bag 1 which comprise the pleats, as well as the direction along which the pleats run along microwave liner bag 1.

Figure 2:
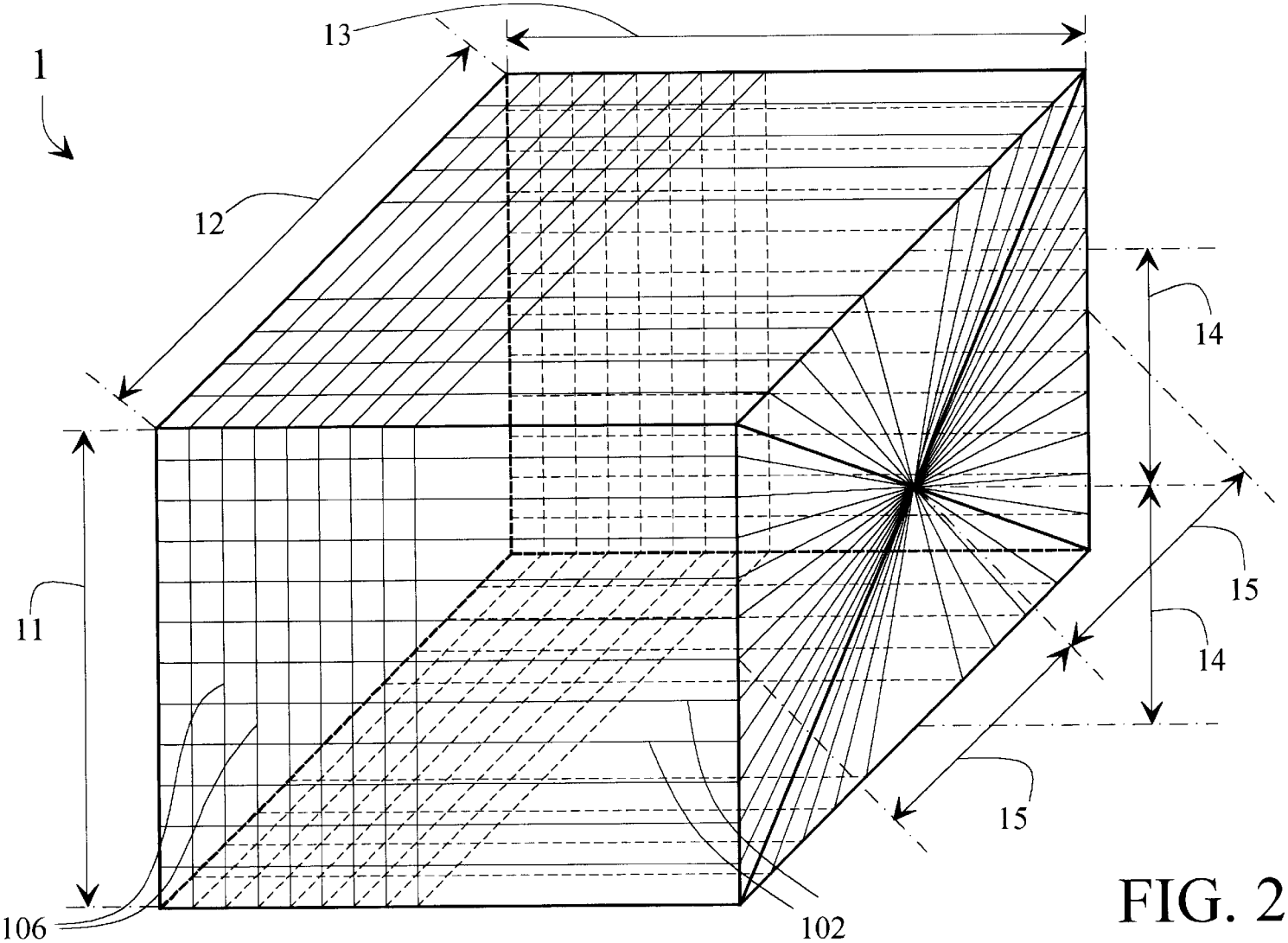
FIG. 2 is a top-rear-right side perspective view illustrating the resizable microwave liner bag of FIG. 1, in a fully expanded state with all of its pleats opened.

FIG. 2 illustrates the resizable microwave liner bag of FIG. 1, in a fully expanded state with all of its pleats opened. In its fully expanded state, microwave liner bag 1 now has a height 11 of approximately 15 inches (as opposed to approximately 6 inches in its fully collapsed state), and a width 12 of approximately 21 inches (as opposed to approximately 11 inches in its fully collapsed state). The depth 13 remains at 18 inches, but again, this depth is reduced by cutting or tearing microwave liner bag 1 (or folding it over on itself) along one of the depth adjustment lines 106. Again, by using the rightmost depth adjustment line 106, this depth is reduced to the 10 inch depth of the smallest-depth microwaves commonly available.

In this fully expanded state, the pyramid surface of FIG. 1 has become substantially flattened, because the "excess" bag material along height expansion region 14 and width expansion region 15 has been used to expand the rear of microwave liner bag 1 over the 9 inch expansion in height from 6 to 15 inches, and the 10 inch expansion in width from 11 to 21 inches. It can now be understood why height expansion regions 14 are chosen to be 7.5 inches, as this provides the necessary rear expansion bag material to allow the bag height to be expanded to $15=2\times7.5$ inches. It is similarly understood why width expansion regions 15 were chosen to be 10.5 inches, since this provides the necessary rear expansion bag material to allow the bag width to be expanded to $21=2\times10.5$ inches. In short, the two height expansion regions 14 are chosen such that their total length is approximately equal to the height of microwave liner bag 1 in its fully-expanded state, and the two width expansion regions 15 are chosen such that their total length is approximately equal to the width of microwave liner bag 1 in it fully-expanded state. As FIGS. 1 and 2 are drawn roughly to scale with one another, it is to be observed that the distances between pleat 102 lines is larger in FIG. 2 than in FIG. 1, which serves to represent the expansion that has taken place of the pleated sections. Again, these lines do not yet show the pleats themselves.

Figure 3:
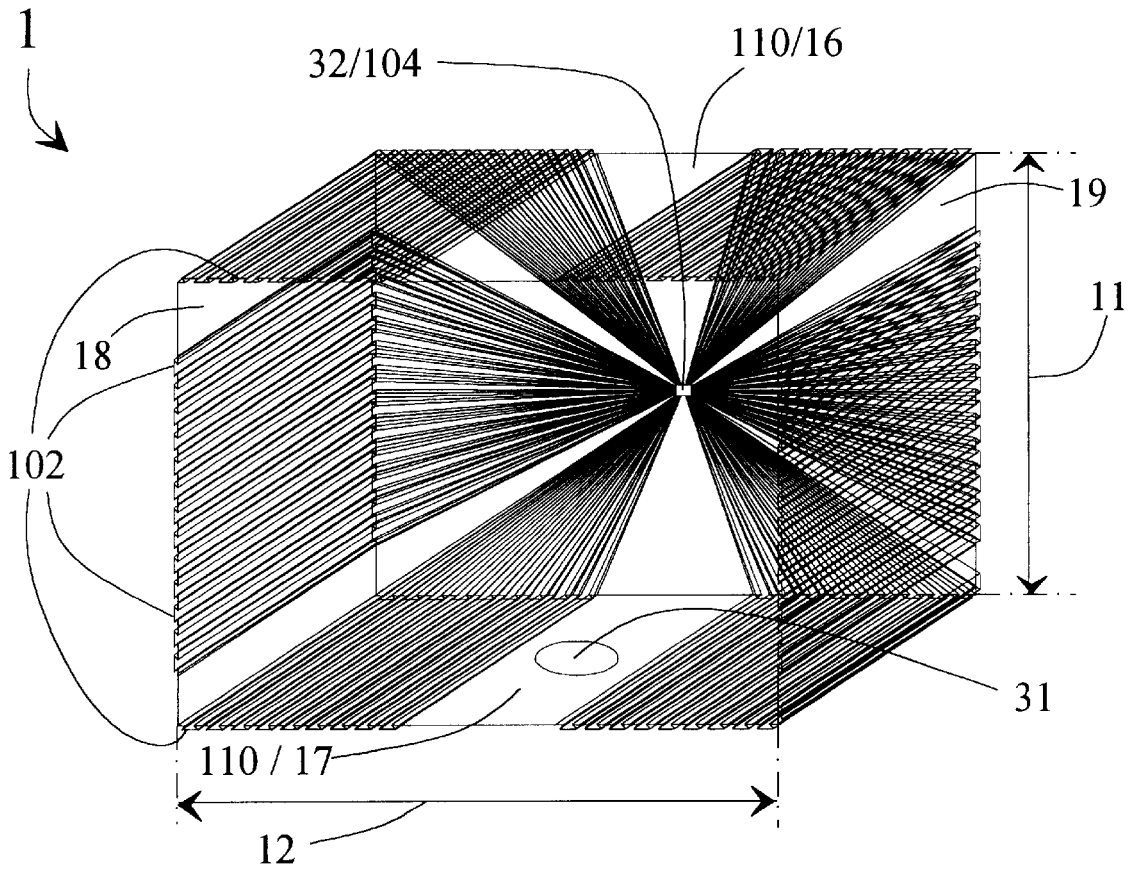
FIG. 3 is a top-front-right side perspective view illustrating the resizable microwave liner bag of FIG. 1, in a partially expanded state with its pleats partially opened, and illustrating in detail, the pleating apparatus and method according to said preferred embodiment of the invention.
Figure 4:
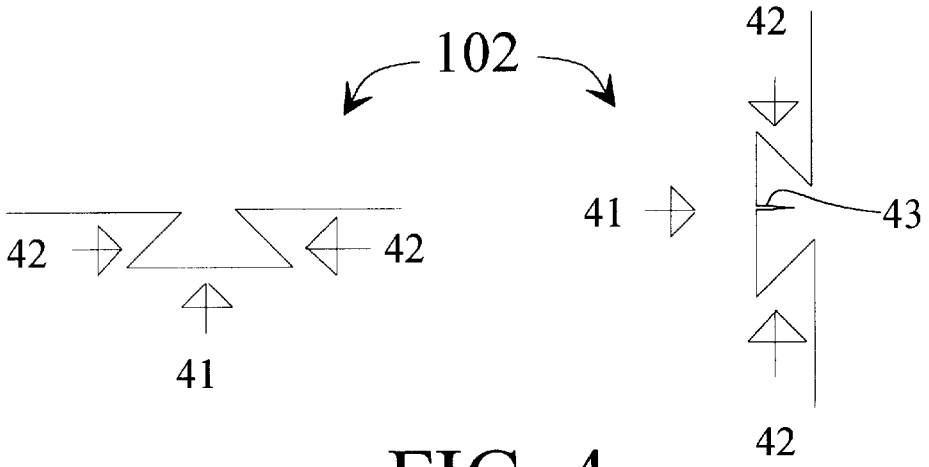
FIG. 4 is an exploded plan view illustrating single, partially opened pleats from FIG. 3.

FIG. 3 shows microwave liner bag 1 from a top-front-right perspective view. In this view, microwave liner bag 1 is partially expanded, and pleats 102, shown in detail here, are partially expanded. FIG. 4 illustrates single pleats 102 in more detail, in their partially-expanded states of FIG. 3. Toward the left of FIG. 4, is a single horizontal pleat, which is representative of a pleat along either the top surface 16 or bottom surface 17 of microwave liner bag 1. Toward the right of FIG. 4, is a single vertical pleat, which is representative of a pleat along either the left surface 18 or right surface 19 of microwave liner bag 1. The reasons for the difference between vertical and horizontal pleats will become apparent below; but it is worth noting for now that in the preferred embodiment, bag width 12 needs to be expandable from approximately 11 to 21 inches, which is less than a doubling of the width. In contrast, the height 11 needs to be expandable from approximately 6 to 15 inches, which is more than a doubling of the height, and in fact, is a 2.5-fold increase in height. In the partially-expanded state of FIG. 3, the pyramid near the rear of microwave liner bag 1, which cannot be seen from this view, is somewhat less-pronounced than it is in FIG. 1, but is not yet fully flattened as in FIG. 3.

Referring to FIG. 4, outer pleat surface 41 for a horizontal pleat 102, in the preferred embodiment, is chosen to be approximately ¼ inch in length, and pleat expansion surfaces 42 are chosen to be approximately ⅛ inch in length. Thus, as a single pleat 102 is unfolded from its fully collapsed state to its fully expanded state, this unfolding will add an extra ¼ inch=2×⅛ inch to the overall width of microwave liner bag 1, and the individual pleat 102 will itself unfold from ¼ inch to ½ inch, i.e., it will double in size. As it is desired in the embodiment of FIGS. 1 through 3 to expand the width to be anywhere from 11 inches to 21 inches, i.e., a total up to 10 inches, a total of 40=10/(2×⅛) pleats 102 are necessary along bag width 12. These 40 pleats, when fully collapsed, are ¼ inch each, and will thus yield a total of 10=40×¼ inches in bag width 12. The extra 1 inch, is provided by unpleated regions 110, bringing the unexpanded width to 11=10+1 inches. When these 40 pleats are fully expanded, they will double in size to ½ inch each, and will thus yield a total of 20=40×½ inches in bag width, with the extra 1 inch from unpleated regions 110 bringing the fully-expanded width of 21=20+1 inches. It is assumed here, and throughout, that each pleat 102 is adjacent to the next pleat 102 as closely as possible, but without overlap. Of course, the above described configuration is illustrative only, and can obviously be varied by someone ordinary skill in the art, within the scope of this disclosure and its associated claims.

In contrast, pleats 102 along height 11 of microwave liner bag 1 take the form of the pleat shown toward the right of FIG. 4, and include, for example, a pleat extender section 43 comprising additional material that enables each pleat to expand by a factor of greater than 2 to 1. This is because the height 11 of microwave liner bag 1, in order to accommodate all conventional microwave sizes, must increase from 6 to 15 inches. It is apparent on close inspection, that the pleats shown toward the left of FIG. 4 can gain at most a 2 to 1 expansion, and that simple adding more pleats will not resolve this, but will merely increase the unexpanded height 11 of microwave liner bag 1 beyond the desired 5 inches.

Thus, the vertical pleats 102 are similar to the earlier-described horizontal pleats 102, but comprise added pleat extender sections 43 comprising two halves of approximately 1/16 inch in length apiece. When these pleats—which start off in their contracted state at ¼ inch apiece—are fully expanded, they gain ¼ inch=2×⅛ inch from each of the two pleat expansion surfaces 42, as well as an additional ⅛ inch=2×1/16 inch from each of the pleat extender sections 43. Thus, the overall gain per pleat is ⅜ inch=¼ inch (from 42)+⅛ inch (from 43), and each pleat thus expands from ¼ inch to ⅝ inch=¼ inch+⅜ inch. This is a gain of 2.5 to 1 (i.e., ⅝ to ¼) per pleat, which mirrors the overall gain need to go from 6 inches to 15 inches in height 11. Thus, with a total of 24 such pleats 102, one can expand from 6 inches=24 pleats×¼ inch per pleat, to 15 inches=24 pleats×⅝ inch per pleat. Here, no unpleated region such as 110 is needed.

It is to be noted that FIG. 3 actually shows approximately 20 pleats along width 12, and approximately 18 pleats along height 11. This is done simply to avoid overcrowding the drawing; thus if all of the aforementioned dimensions for the preferred embodiment of FIGS. 1 through 3 are to be employed in a particular reduction to practice, FIG. 3 actually illustrates approximately one pleat horizontal pleat to represent approximately every two horizontal pleats that are needed for the reduction to practice, and approximately 3 vertical pleats for every 4 that are needed for reduction to practice.

Alternatively, for example, if outer pleat surface 41 were chosen to be ½ inch, pleat expansion surfaces 42 were chosen to be ¼ inch, and the two halves of pleat extender sections 43 were chosen to be approximately ⅛ inch in length apiece, then FIG. 3 would illustrate substantially a one-to-one correspondence between the number of pleats required, and the number represented in FIG. 3. The ⅛ inch pleat expansion surfaces 42 and 1/16 inch pleat extender sections 43 are chosen for the preferred embodiment, since they provide expansion in ⅛ inch increments if half of a single pleat 102 is unfolded, in ¼ inch increments if an entire pleat 102 is unfolded and in ⅜ inch increments if a pleat extender sections 43 is also unfolded. This is desirable since the dimensions of commonly-available microwaves typically vary in ⅛ or ¼ inch increments, and this provides greater incremental expansion capability.

It will be obvious to someone of ordinary skill how to vary and generalize all of the aforementioned choices of pleat dimension as well as the number of pleats, at will, to provide any desired overall expansion of height 11 and width 12 for microwave liner bag 1. Any such variation or generalization is considered to be within the scope of this disclosure and its associated claims. In particular, the choice of having height 11 vary from 6 inches to 15 inches, width 12 vary from 11 inches to 21 inches, and depth 13 vary from 10 inches to 18 inches, is not made in the abstract; but is made to accommodate the sizes of microwaves as they are customarily manufactured. If microwaves were to be manufactured which exceed one or more of the maximum dimensions noted above, or are smaller along one or more of the minimum dimensions noted above, then the specifications for microwave liner bag 1 can easily and obviously be varied to accommodate this. Similarly, once the suitable maximum and minimum dimensions have been specified for microwave liner bag 1, one can vary the individual pleat 102 specifications as desired, recognizing the simple and obvious generalizations of the relationships among individual pleat characteristics, number of pleats, and desired size ranges, as outlined above for the preferred embodiment outlined above and chosen by way of example only, not limitation.

Similarly, depth adjustment lines 106 are for illustration only, and may be incorporated into microwave liner bag 1 as desired. For example, not limitation, these can be separated by ¼ or ⅛ inch from one another to accommodate the ¼ or ⅛ inch depth increments that are typical in commonly-available microwave ovens. And the range of depth from 10 inches to 18 inches that is achieved by these depth adjustment lines 106 is again based on the depth of commonly-available microwave ovens. If ovens with larger depths than 18 inches, or smaller depths than 10 inches, were to become available, it would be obvious how to modify the specifications for microwave liner bag 1 in order to accommodate this.

Figure 5:
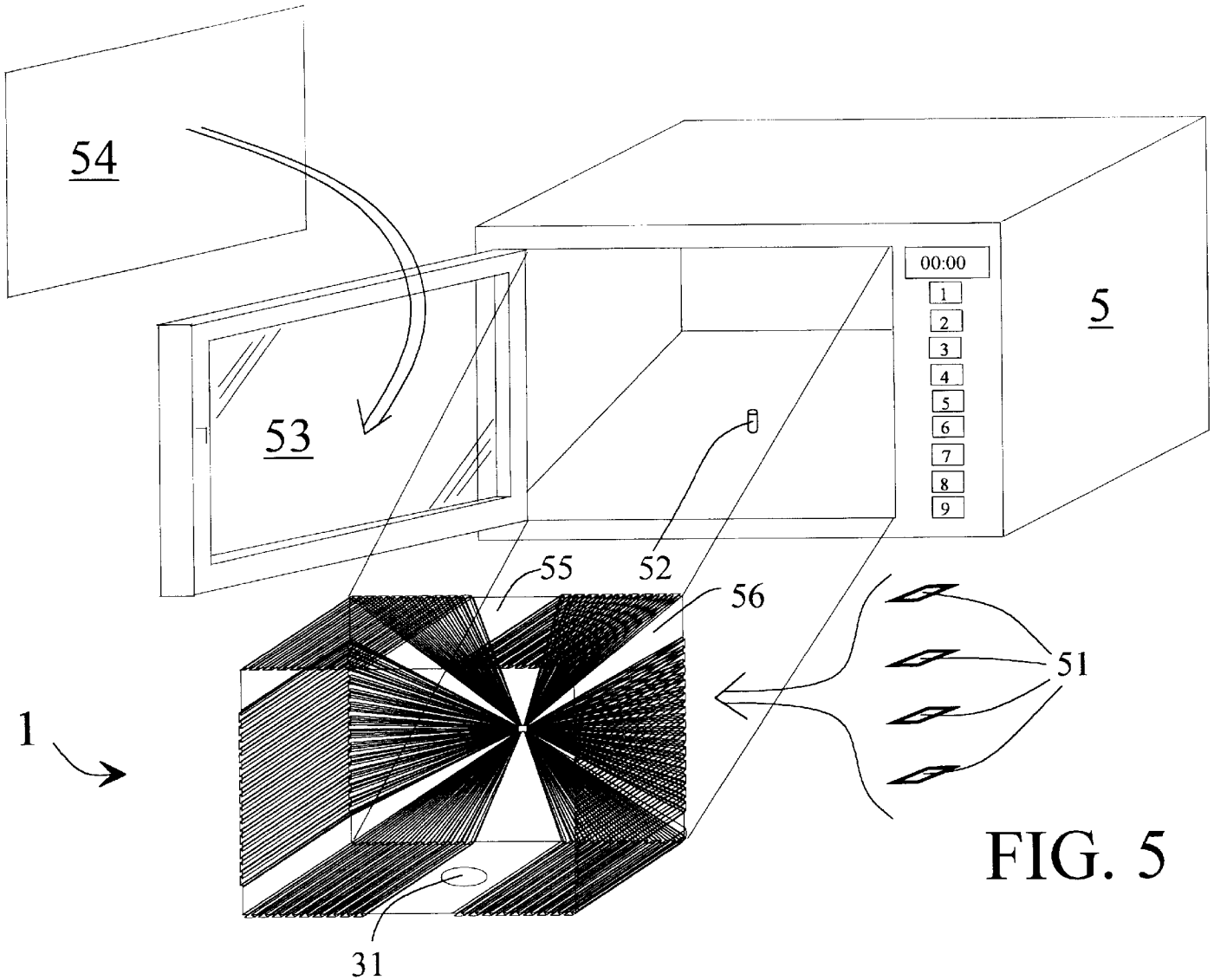
FIG. 5 is a perspective view illustrating the placement of the microwave liner bag of FIG. 1 into a microwave oven, as well as a separate microwave door liner used to protect the inside of the front microwave oven door.

FIG. 3 also illustrates a turntable aperture 31 along unpleated region 110 of bottom surface 17 through which the spindle of a microwave turntable can pass when microwave liner bag 1 is placed into a microwave oven 5 (see FIG. 5). Also illustrated is a pleat gathering means 32 proximate a pleat gathering point 104, which may comprise, for example, not limitation, a microwave-safe (e.g. plastic, ceramic) staple or constricting ring designed to hold together the pleats 102 near the pyramid apex so that they do not fall apart toward the rear of the bag as microwave liner bag 1 is being expanded. It is to be observed that the pleats 102 along the pyramid surface of microwave liner bag 1 are simply extensions of the pleats 102 along the top 16, bottom 17, and sides 18 and 19 of microwave liner bag 1, gathered together to all join up and be gathered together at pleat gathering point 104.

FIG. 5 illustrates the placement of microwave liner bag 1 into a microwave oven 5. Prior to placing microwave liner bag 1 into microwave oven 5, pleats 102 are unfolded until microwave liner bag 1 is enlarged to accommodate the height and width of the particular microwave oven 5 with which the bag is to be used.

FIGS. 1 through 3 of course, illustrate microwave liner bag 1 at various stages of expansion, from fully-contracted (FIG. 1) through partially-expanded (FIG. 3), through fully-expanded (FIG. 2). If microwave liner bag 1 includes optional depth adjustment lines 106, then microwave liner bag 1 is also torn, cut or folded over itself along a chosen depth adjustment line 106 to size microwave liner bag 1 to the depth necessary to accommodate the microwave oven 5 for which it is being used. If optional depth adjustment lines 106 are not included, then microwave liner bag 1 is still folded in on itself to the necessary depth, or, alternatively, is cut to the proper depth using commonly-available cutting means such as, but not limited to, scissors. The term "depth reduction means" as used herein, refers to any suitable means used to reduce the depth of liner bag 1, including, but not limited to, depth adjustment lines 106 earlier discussed, cutting by any suitable cutting means even in the absence of depth adjustment lines 106, folding the liner over on itself even in the absence of depth adjustment lines 106, etc.

Once the height 11, width 12 and depth 13 of microwave liner bag 1 are adjusted to fit microwave oven 5, microwave liner bag 1 is then inserted into microwave oven 5 as shown. Bag-to-oven securing means 51 are placed upon and attached to microwave liner bag 1 at one or more suitable securing locations, and then, as microwave liner bag 1 is inserted into microwave oven 5, are pressed against and attached to the inside surface of microwave oven 5 on the top, bottom, side and/or rear interior walls of microwave oven 5. Bag-to-oven securing means 51 may be, for example, not limitation, double sided tape separate from microwave liner bag 1, or tape already pre-attached to microwave liner bag 1 at one or more suitable securing locations. During this insertion process, if microwave oven 5 has a turntable, the turntable is removed, turntable spindle aperture 31 is placed over the turntable spindle 52 upon which the turntable rests, and the turntable is then placed back upon the spindle. The rear, pyramid surface of liner bag 1 is "scrunched" as necessary against the rear of the microwave oven so that it is substantially flush against the rear of the microwave oven, irrespective of how large or small the pyramid might be.

At this point, the top, bottom, rear, and both side interior walls of microwave oven 5 are protected from spatter by microwave liner bag 1. But it is also desirable to protect microwave oven front door 53. An optional front door liner sheet 54, separate from liner bag 1, is used for this purpose. Front door liner 54 is simply attached to microwave front door 53 as shown, also using bag-to-oven securing means 51. Because most microwave oven front doors 53 have a window through which the inside of microwave oven 5 can be viewed from outside while front door 53 is closed, in the preferred embodiment, front door liner 54 is transparent so as to not obstruct this view.

Many microwave ovens 5 also contain a platform (not shown) attachable to platform support brackets (not shown) on the rear and sides of microwave oven 5. Such a platform is used to support a food item being heated substantially near the center of the oven. If microwave oven 5 contains such a platform and platform supports, microwave liner bag 1 is also pressed firmly over these supports and deformed or torn at the support region such that the supports, or the shape of the supports, will protrude through microwave liner bag 1 in order to support the platform. The platform is then placed over the supports, or over the sections of microwave liner bag 1 that envelop these supports.

It is also understood, while liner bag 1 shows all of a pleated top surface 16, bottom surface 17, left surface 18, right surface 19, and rear surface comprising the pyramid surface earlier shown and described, that an alternative embodiment could leave out the rear surface, and simply include pleated top, bottom and side surfaces embodied in a four-sided, rather than a five-sided liner apparatus 1. In this embodiment, the rear surface of microwave oven 5 can alternatively be protected, for example, by a separate rear surface liner sheet substantially similar to separate front door liner sheet 54.

Ideally, the liner material used to construct microwave liner bag 1 should have structural integrity and be able to free-stand in the microwave device on its own, requiring minimal or no supports. This material should still be free-standing after many microwave uses, and should need to be disposed of because of the spilled food that it has prevented from being caked on the microwave surface—not due to the liner becoming deformed from heat. The ideal material should also not allow food to be absorbed or soaked into its surface, as this would cause the liner to stick to the microwave surface, defeating its purpose.

Therefore, materials meeting the requirements would be able to withstand repeated microwave bombardment and not become distorted from the water vapor or steam resulting from routine food preparation. High-density polyethylene, high-density polypropylene, high-density polystyrene, polycarbonates, polyethylene, polypropylene, polystyrene, and blends containing these polymers meet these requirements. These materials have a high heat distortion temperature and therefore can withstand repeated microwave bombardment and the steam that results in day-to-day food preparation. They also will not absorb food spatters into their surface.

It is also to be noted that many microwave ovens 5 contain lights to light their interior region, and/or fans for air circulation. It may therefor be desirable for the material used to fabricate liner 1 to have, for example, a transparent or cutout (e.g., using perforations) region 55 proximate the light location, and to have, e.g., vent regions 56 (e.g., small aperture vents) for air passage proximate any air fans. It is understood that the proper location for these light and air passages will likely vary from one microwave model to the next, due to differing placements of lights and fans on different microwave models, and that locations 55 and 56 are simply marked as an example.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A microwave oven liner, comprising:

a top surface;

a bottom surface;

a left side surface; and a right side surface; wherein:

said top and bottom surfaces are capable of being expanded from a fully collapsed state of predetermined minimum width to a fully expanded state of predetermined maximum width, and to an intermediate expansion state of any chosen width between said minimum width and said maximum width;

said left and right side surfaces are capable of being expanded from a fully collapsed state of predetermined minimum height to a fully expanded state of predetermined maximum height, and to an intermediate expansion state of any chosen height between said minimum height and said maximum height; and said microwave oven liner is capable of being placed into a microwave oven substantially proximate respective top, bottom, left side, and right side interior walls of an interior of said microwave oven.

2. The microwave oven liner of claim 1:

said top and bottom surfaces comprising at least one horizontal pleat running from a front of said top and bottom surfaces to a rear of said top and bottom surfaces, enabling said top and bottom surfaces to be so-expanded; and said left and right side surfaces comprising at least one vertical pleat running from a front of said left and right side surfaces to a rear of said left and right side surfaces, enabling said left and right side surfaces to be so-expanded.

3. The microwave oven liner of claim 2, further comprising:

a rear surface capable of being placed into said microwave oven substantially proximate a rear interior wall of said microwave oven, comprising at least one rear surface pleat running from said rear of said top, bottom, left, and right side surfaces to a pleat gathering point, wherein:

said rear surface, when said microwave oven liner is in said fully collapsed state, forms a pyramid surface with said pleat gathering point proximate an apex of said pyramid surface; and wherein said rear surface, when said microwave oven liner is in said fully expanded state, becomes substantially flattened.

4. The microwave oven liner of claim 1, further comprising:

a rear surface liner sheet separate from said top, bottom, left side, and right side surfaces, capable of being placed into said microwave oven substantially proximate a rear interior wall of said microwave oven.

5. The microwave oven liner of claim 1, further comprising:

a front door liner sheet separate from said top, bottom, left side, and right side surfaces, capable of being placed into said microwave oven substantially proximate a front door of said microwave oven.

6. The microwave oven liner of claim 1, wherein:

said top, bottom, left side and right surfaces are capable of being reduced from a predetermined maximum depth to a predetermined minimum depth, and to an intermediate state of any chosen depth between said maximum depth and said minimum depth.

7. The microwave oven liner of claim 6, further comprising a plurality of depth adjustment lines running from left sides of said top and bottom surfaces to right sides of said top and bottom surfaces, and from tops of said left and right side surfaces to bottoms of said left and right side surfaces, enabling said depth to be so-reduced.

8. The microwave oven liner of claim 1, further comprising:

bag-to-oven securing means securing said microwave oven liner to at least one location upon said microwave oven interior.

9. The microwave oven liner of claim 1, said microwave oven liner further comprising a liner material which:

possesses sufficient structural rigidity to freely stand within said microwave oven without any additional independent support structure;

maintains said structural rigidity throughout repeated microwave bombardment and heating; and substantially does not absorb food spatter.

10. The microwave oven liner of claim 1, said oven liner further comprising a liner material selected from the polymer group consisting of:

high-density polyethylene; high-density polypropylene; high-density polystyrene; polycarbonates; polyethylene; polypropylene; polystyrene; and blends comprising more than one of high-density polyethylene; high-density polypropylene; high-density polystyrene; polycarbonates; polyethylene; polypropylene; and polystyrene.

11. The microwave oven liner of claim 1, said microwave oven liner further comprising at least one transparent region enabling light to pass therethrough.

12. The microwave oven liner of claim 1, said microwave oven liner further comprising at least one venting region enabling air to pass therethrough.

13. The microwave oven liner of claim 1, further comprising:

a rear surface capable of being placed into said microwave oven substantially proximate a rear interior wall of said microwave oven when said top, bottom, left side and right side surfaces are in a given said state of expansion.

14. The microwave oven liner of claim 1:

said left and right side surfaces comprising at least one vertical pleat running from a front of said left and right side surfaces to a rear of said left and right side surfaces, enabling said left and right side surfaces to be so-expanded.

15. The microwave oven liner of claim 14, further comprising:

a rear surface capable of being placed into said microwave oven substantially proximate a rear interior wall of said microwave oven, comprising at least one rear surface pleat adjoining said at least one vertical pleat.

16. The microwave oven liner of claim 1, wherein said top surface, said bottom surface, said left side surface, and said right side surface form a continuous, unitary structure.

17. The microwave oven liner of claim 1, further comprising a turntable spindle aperture.

18. A method for protecting a microwave oven from food spatter, comprising the steps of:

expanding top and bottom surfaces of a microwave oven liner from a fully collapsed state of predetermined minimum width to a fully expanded state of predetermined maximum width, and to an intermediate expansion state of any chosen width between said minimum width and said maximum width; and expanding left and right side surfaces of said microwave oven liner from a fully collapsed state of predetermined minimum height to a fully expanded state of predetermined maximum height, and to an intermediate expansion state of any chosen height between said minimum height and said maximum height; and placing said microwave oven liner into said microwave oven substantially proximate respective top, bottom, left side, and right side interior walls of an interior of said microwave oven.

19. The method of claim 18, wherein:

said step of expanding said top and bottom surfaces comprises using at least one horizontal pleat of said top and bottom surfaces running from a front of said top and bottom surfaces to a rear of said top and bottom surfaces; and said step of expanding said left and right side surfaces comprises using at least one vertical pleat of said left and right side surfaces running from a front of said left and right side surfaces to a rear of said left and right side surfaces.

20. The method of claim 19, comprising the further steps of:

when said microwave oven liner is in said fully collapsed state, forming a pyramid surface comprising a rear surface of said microwave oven liner bag, with a pleat gathering point of said rear surface proximate an apex of said pyramid surface;

when said microwave oven liner is in said fully expanded state, substantially flattening said rear surface; and placing said rear surface into said microwave oven substantially proximate a rear interior wall of said microwave oven, said rear surface comprising at least one rear surface pleat running from said rear of said top, bottom, left, and right side surfaces to said pleat gathering point.

21. The method of claim 18, comprising the further step of:

placing a rear surface liner sheet separate from said top, bottom, left side, and right side surfaces, into said microwave oven substantially proximate a rear interior wall of said microwave oven.

22. The method of claim 18, comprising the further step of:

placing a front door liner sheet separate from said top, bottom, left side, and right side surfaces, into said microwave oven substantially proximate a front door of said microwave oven.

23. The method of claim 18, comprising the further steps of:

reducing said top, bottom, left side and right surfaces from a predetermined maximum depth to a predetermined minimum depth, and alternatively, to an intermediate state of any chosen depth between said maximum depth and said minimum depth.

24. The method of claim 23, wherein said step of reducing said depths of said top, bottom, left side and right surfaces comprises using a plurality of depth adjustment lines running from left sides of said top and bottom surfaces to right sides of said top and bottom surfaces, and from tops of said left and right side surfaces to bottoms of said left and right side surfaces.

25. The method of claim 18, comprising the further step of:

securing said microwave oven liner to at least one location upon said microwave oven interior using bag-to-oven securing means.

26. The method of claim 18, comprising the further step of fabricating said microwave oven liner from a liner material:

possessing sufficient structural rigidity to freely stand within said microwave oven without any additional independent support structure;

maintaining said structural rigidity throughout repeated microwave bombardment and heating; and substantially not absorbing food spatter.

27. The method of claim 18, comprising the further step of fabricating said microwave oven liner from a liner material selected from the polymer group consisting of:

high-density polyethylene; high-density polypropylene; high-density polystyrene; polycarbonates; polyethylene; polypropylene; polystyrene; and blends comprising more than one of high-density polyethylene; high-density polypropylene; high-density polystyrene; polycarbonates; polyethylene; polypropylene; and polystyrene.

28. The method of claim 18, comprising the further step of:

enabling light to pass through at least one transparent region of said microwave oven liner.

29. The method of claim 18, comprising the further step of:

enabling air to pass through at least one venting region of said microwave oven liner.

30. The method of claim 18, comprising the further steps of:

when said top, bottom, left side and right side surfaces are in a given said state of expansion, placing said rear surface into said microwave oven substantially proximate a rear interior wall of said microwave oven.

31. The method of claim 18, wherein:

said step of expanding said left and right side surfaces comprises using at least one vertical pleat of said left and right side surfaces running from a front of said left and right side surfaces to a rear of said left and right side surfaces.

32. The method of claim 17, comprising the further step of:

placing a rear surface of said microwave oven liner into said microwave oven substantially proximate a rear interior wall of said microwave oven, said microwave oven liner comprising at least one rear surface pleat adjoining said at least one vertical pleat.

33. The method of claim 18:

said top surface, said bottom surface, said left side surface, and said right side surface forming a continuous, unitary structure.

34. The method of claim 18, said microwave oven liner further comprising a turntable spindle aperture.

* * * * *